US011120769B2

(12) United States Patent
Deng et al.

(10) Patent No.: US 11,120,769 B2
(45) Date of Patent: Sep. 14, 2021

(54) BRIGHTNESS COMPENSATION METHOD AND RELATED PRODUCT

(71) Applicant: SHENZHEN CHINA STAR OPTOELECTRONICS SEMICONDUCTOR DISPLAY TECHNOLOGY CO., LTD., Guangdong (CN)

(72) Inventors: Yufan Deng, Guangdong (CN); Yuan-Chun Wu, Guangdong (CN); Po-Yen Lu, Guangdong (CN); ShenSian Syu, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 578 days.

(21) Appl. No.: 16/069,322

(22) PCT Filed: Feb. 6, 2018

(86) PCT No.: PCT/CN2018/075443

§ 371 (c)(1),
(2) Date: Jul. 11, 2018

(87) PCT Pub. No.: WO2019/136787

PCT Pub. Date: Jul. 18, 2019

(65) Prior Publication Data

US 2021/0082370 A1 Mar. 18, 2021

(30) Foreign Application Priority Data

Jan. 12, 2018 (CN) ..... 201810031331.X

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0233* (2013.01);
(Continued)

(58) Field of Classification Search
CPC ..... G09G 5/10; G09G 3/3225; G09G 2320/0646; G09G 2370/16; G09G 2354/00; G09G 2320/0233
See application file for complete search history.

(56) References Cited

U.S. PATENT DOCUMENTS

2004/0070558 A1 4/2004 Cok et al.
2006/0238551 A1* 10/2006 Dalal ..... G09G 3/3648 345/690

(Continued)

FOREIGN PATENT DOCUMENTS

CN 103474016 A 12/2013
CN 104464626 A 3/2015

(Continued)

OTHER PUBLICATIONS

Office Action dated Jun. 12, 2019 from corresponding application No. CN 201810031331.X.

*Primary Examiner* — Sahlu Okebato
(74) *Attorney, Agent, or Firm* — Leong C. Lei

(57) ABSTRACT

A brightness compensation method and related product are disclosed. The method includes steps of receiving at least one compensation table sent from a mobile terminal by a driving device, and obtaining a target grayscale value of a target pixel point in a first display picture of the display device, determining a fixing value corresponding to the target pixel point according to the at least one compensation table, performing a brightness compensation to the target pixel point according to the fixing value, and driving the display device to display the first display picture after performing the brightness compensation. The embodiment of the present application can eliminate a brightness uneven phenomenon in the first display picture caused by attenuation of the luminous efficiency of the OLED device.

3 Claims, 5 Drawing Sheets

(52) U.S. Cl.
CPC . *G09G 2320/0646* (2013.01); *G09G 2354/00* (2013.01); *G09G 2370/16* (2013.01)

(56) References Cited

U.S. PATENT DOCUMENTS

| | | | | |
|---|---|---|---|---|
| 2009/0066731 | A1* | 3/2009 | Kim | G09G 3/3607 345/690 |
| 2016/0180782 | A1* | 6/2016 | Nakaya | G09G 3/3648 345/690 |

FOREIGN PATENT DOCUMENTS

| | | | | |
|---|---|---|---|---|
| CN | 105280157 | A | | 1/2016 |
| CN | 105788563 | A | | 7/2016 |
| CN | 105895056 | A | | 8/2016 |
| CN | 106531070 | A | | 3/2017 |
| CN | 107221290 | A | * | 9/2017 |
| CN | 107221290 | A | | 9/2017 |
| CN | 107248389 | U | | 10/2017 |
| CN | 107274834 | A | | 10/2017 |
| JP | 2001188513 | A | | 7/2001 |

* cited by examiner

BRIGHTNESS COMPENSATION METHOD AND RELATED PRODUCT

CROSS REFERENCE

The present application is a National Phase of International Application Number PCT/CN2018/075443, filed Feb. 6, 2018, which claims the priority of Chinese Patent Application No. 201810031331X, entitled "brightness compensation method and related product", filed on Jan. 12, 2018, the disclosure of which is incorporated herein by reference in its entirety.

FIELD OF THE INVENTION

The present invention relates to a display technology field, and more particularly to a brightness compensation method and related product.

BACKGROUND OF THE INVENTION

An Organic Light-Emitting Diode (OLED) has features of high contrast, wide viewing angle, low power consumption. However, after the OLED device is ageing, the brightness is decreased and the color point is drift. The main reason is that the threshold voltage drift of the Thin Film Transistor (TFT) and the attenuation of the luminous efficiency of the OLED device. The decline of the display brightness is proportional to the ageing time of the OLED device. If the ageing degree pf the OLED device of each pixel is different, a blur or an uneven brightness of the display device may generate.

The common compensation technology can be divided into an optical compensation and an electrical compensation. Wherein, the optical compensation can improve the electrical properties of the TFT, the uneven brightness display caused by the luminous efficiency of the OLED device. However, the optical compensation is finished before delivery, which is not suitable for the uneven brightness display of the OLED device in the using process. The electrical compensation can improve the uneven brightness display caused by the threshold voltage drift of the TFT, but is not suitable for the uneven brightness display caused by the attenuation of the luminous efficiency of the OLED device. Accordingly, the above two technology cannot improve the uneven brightness display caused by the attenuation of the luminous efficiency of the OLED device after delivery.

SUMMARY OF THE INVENTION

The embodiment of the present application provides a brightness compensation method and related product, a brightness uneven phenomenon in the first display picture caused by attenuation of the luminous efficiency of the OLED device can be eliminated.

In a first aspect, the embodiment of the preset application provides a brightness compensation method, comprising steps of:

receiving at least one compensation table sent from a mobile terminal by a driving device;

obtaining a target grayscale value of a target pixel point in a first display picture of the display device, determining a fixing value corresponding to the target pixel point according to the at least one compensation table, performing a brightness compensation to the target pixel point according to the fixing value, and driving the display device to display the first display picture after performing the brightness compensation.

In a second aspect, the embodiment of the preset application provides a brightness compensation method, comprising steps of:

building at least one compensation table by a mobile terminal; and sending the at least one compensation table to a driving device, and obtaining a target grayscale value of a target pixel point in the first display picture displayed by a display device through the driving device, determining a fixing value corresponding to the target pixel point according to the at least one compensation table, performing a brightness compensation for the target pixel point according to the fixing value, and displaying the first display picture after performing the brightness compensation on the display device.

In a third aspect, the embodiment of the preset application provides a brightness compensation device, comprising:

a receiving unit used for receiving at least one compensation table sent by a mobile terminal.

a brightness compensation unit used for obtaining a target grayscale value of a target pixel point in a first display picture displayed by the display device, determining a fixing value corresponding to the target pixel point according to the at least one compensation table, performing a brightness compensation to the target pixel point according to the fixing value, and driving the display device to display the first display picture after performing the brightness compensation.

In a fourth aspect, the embodiment of the preset application provides a brightness compensation device, comprising:

a table building unit used for building at least one compensation table.

a sending unit used for sending the at least one compensation table to the driving device, and obtaining target grayscale values of the target pixel points in the first displaying picture displayed by the display device through the driving device, determining fixing value corresponding to the target pixel points according to the at least one compensation table, performing a brightness compensation for the target pixel points corresponding to the fixing value, and driving the display device to display the first displaying picture after performing the brightness compensation on the display device.

In a fifth aspect, the embodiment of the preset application provides a brightness compensation system, the system includes a display device and a mobile terminal described in the fourth aspect, and the device includes a driving device as described in the third aspect.

In a sixth aspect, the embodiment of the preset application provides a driving device, the driving device includes at least one processor, at least one storage and at least one communication port; and one or multiple procedures; the one or the multiple procedures are stored in the storage, and configured to be executed in the processor, the procedures include instructions for executing the steps in the first aspect.

In a seventh aspect, the embodiment of the preset application provides a mobile terminal, the mobile terminal includes: a processor, a storage and one or multiple procedures; the one or the multiple procedures are stored in the storage, and configured to be executed in the processor, the procedures include instructions for executing the part or all steps in the second aspect.

In an eighth aspect, the embodiment of the preset application provides a computer storage media, wherein, computer storage media is used for storing computer program.

The computer program makes a computer to execute part or all steps in the first aspect of the present application.

In a ninth aspect, the embodiment of the preset application provides a computer readable storage, wherein, computer readable storage is used for storing computer program. Wherein, the computer program makes a computer to execute part or all steps in the second aspect of the present application.

In a tenth aspect, the embodiment of the preset application provides a computer program product, wherein the computer program product includes a non-transitory computer-readable storage medium that stores the computer program, the computer program makes a computer to execute part or all steps in the first aspect of the present application. The computer program product can be a software installation package In an eleventh aspect, the embodiment of the preset application provides a computer program product, wherein the computer program product includes a non-transitory computer-readable storage medium that stores the computer program, the computer program makes a computer to execute part or all steps in the second aspect of the present application. The computer program product can be a software installation package.

The embodiment of the present application has following beneficial effect:

As shown, in the embodiment of the present invention, building at least one compensation table by a mobile terminal; and sending the at least one compensation table to a driving device; receiving at least one compensation table sent from a mobile terminal by a driving device; obtaining a target grayscale value of a target pixel point in a first display picture of the display device, determining a fixing value corresponding to the target pixel point according to the at least one compensation table, wherein, each compensation table includes an original grayscale value of at least one pixel in a display picture of a display device, and a brightness compensation value corresponding to the original grayscale value, obtaining the fixing value according to at least one original grayscale value and at least one brightness compensation value, performing a brightness compensation to the target pixel point according to the fixing value, and driving the display device to display a first display picture after being compensated in brightness. A brightness uneven phenomenon in the first display picture caused by attenuation of the luminous efficiency of the OLED device can be eliminated. Besides, building the compensation table through the server, the operation of the mobile device can be saved in order to shorten the time for building the compensation table.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the person of ordinary skill in the art without creative effort, it can also obtain other figures according to these figures.

DETAILED DESCRIPTION OF THE PREFERRED EMBODIMENT

The following content combines with the drawings and the embodiment for describing the present invention in detail. It is obvious that the following embodiments are only some embodiments of the present invention. For the person of ordinary skill in the art without creative effort, the other embodiments obtained thereby are still covered by the present invention.

In the specification, claims, and accompanying drawings of the present disclosure, the terms "first", "second", and so on are intended to distinguish between similar objects but do not necessarily indicate a specific order or sequence. It should be understood that the data termed in such a way are interchangeable in proper circumstances such that the embodiments of the present disclosure described herein can be implemented in other orders than the order illustrated or described herein. Moreover, the terms "include", "contain" and any other variants mean to cover the non-exclusive inclusion, for example, a process, method, system, product, or device that includes a list of steps or units is not necessarily limited to those units, but may include other steps or units not expressly listed or inherent to such a process, method, system, product, or device.

Figure 1A:
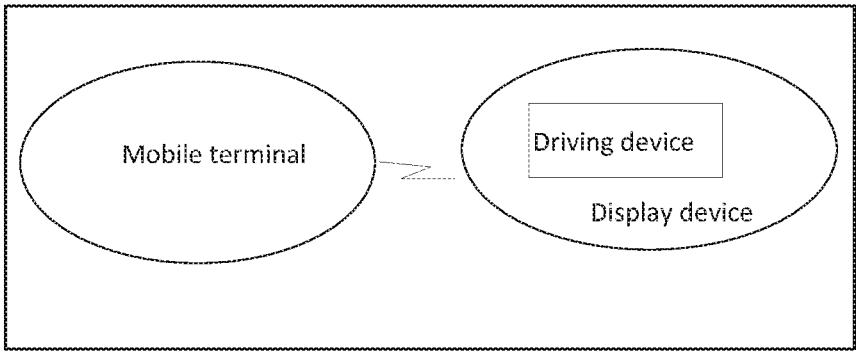
FIG. 1A is a schematic diagram of a brightness compensation system according to an embodiment of the present application.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments necessarily mutually exclusive of other embodiments. Moreover, various features are described that may be exhibited by some embodiments and not by others. Similarly, various requirements are described that may be requirements for some embodiments and not for other embodiments With reference to FIG. 1A, FIG. 1A is a schematic diagram of a brightness compensation system according to an embodiment of the present application. Wherein, the display device includes a driving device, the driving device is used for driving a display device to display a picture formed by pixels having various colors. The mobile terminal and the driving device are connected through a wireless method. The embodiment of the present invention can be realized through a brightness compensation system shown in FIG. 1A of the present application.

Figure 1B:
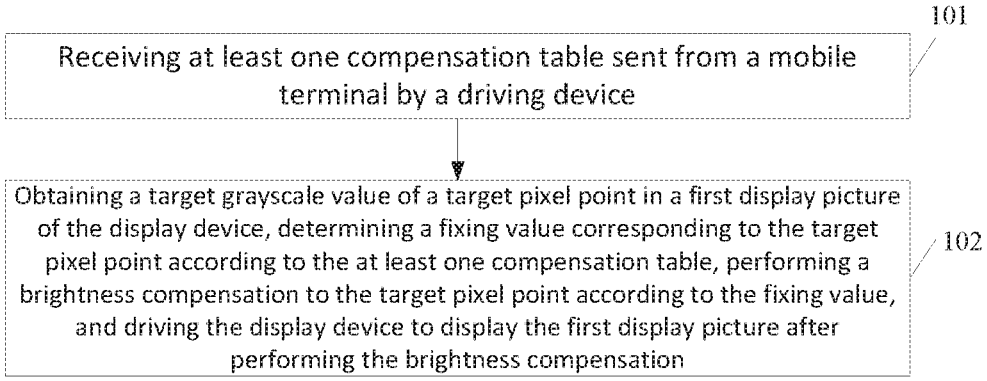
FIG. 1B is a flowchart of a brightness compensation method according to an embodiment of the present invention.

With reference to FIG. 1B, FIG. 1B is a flowchart of a brightness compensation method according to an embodiment of the present invention. As shown in FIG. 1B, the brightness compensation method described I the present embodiment includes following steps:

101: receiving at least one compensation table sent from a mobile terminal by a driving device.

In some embodiments of the present application, the driving device can be connected with the mobile terminal through a wireless way, and receiving at least one compensation table sent by the mobile terminal.

Wherein, each compensation table includes an original grayscale value of at least one pixel in a display picture of a display device, and a brightness compensation value corresponding to the original grayscale value.

102: obtaining a target grayscale value of a target pixel point in a first display picture of the display device, determining a fixing value corresponding to the target pixel point according to the at least one compensation table, performing a brightness compensation to the target pixel point according to the fixing value, and driving the display device to display the first display picture after performing the brightness compensation.

In the present embodiment, a content of a first picture displayed by the display device includes N pixel points, N is an integer that is greater than 1, and the target pixel point can be any pixel point in the N pixel points.

Wherein, the first display picture can include a display picture formed by N pixel points having arbitrary grayscale values. For example, the first display picture can be a pure color picture or a colorful picture.

Wherein, the target grayscale value is a grayscale value of a target pixel point which should be displayed in a first display picture. Because of attenuation of the light-emitting efficiency generated by the ageing of the organic light emitting diode, a brightness compensation for the target pixel point is required.

Optionally, performing a brightness compensation to the target grayscale value of the target pixel point in the first display picture can base on the original grayscale value and a brightness compensation value corresponding to the target pixel point in the compensation table to calculate the fixing value of the target pixel point.

Optionally, in the above step 102, the step of determining a fixing value corresponding to the target pixel point according to the at least one compensation table can include following steps:

Step 21: if in the at least one compensation table, only a first compensation table is existed and including a first grayscale vale gs1 and a first brightness compensation vale ΔX1 corresponding to the target pixel point, obtaining the first grayscale value gs1 and the first brightness compensation vale ΔX1 in the first compensation table, and calculating the fixing value L corresponding to the target pixel point according to a following formula:

$$L=\text{gray0}+\Delta X_1-\text{gs1}$$

wherein, gray0 is the target grayscale value of the target pixel point in the first display picture displayed by the display device.

Step 22: if in the at least one compensation table, a second compensation table is existed and including a second grayscale value gs2 and a second brightness compensation value ΔX2 corresponding to the target pixel point, and a third compensation table is existed and including a third grayscale value gs3 and a third brightness compensation value ΔX3 corresponding to the target pixel point, obtaining the second grayscale value gs2 and the second brightness compensation value ΔX2 corresponding to the target pixel point in the second compensation table and obtaining the third grayscale value gs3 and the third brightness compensation value ΔX3 corresponding to the target pixel point in the third compensation table, calculating the fixing value L corresponding to the target pixel point according to a following formula:

$$L=\Delta X_2+(\text{gray0}-\text{gs2})*(\Delta X_3-\Delta X_2)/(\text{gs3}-\text{gs2})$$

wherein, gray0 is the target grayscale value of the target pixel point in the first display picture displayed by the display device.

In the present embodiment, the at least on compensation table includes the original grayscale value and a brightness compensation value corresponding to the target pixel point.

Optionally, the driving device can determine a location of the target pixel point in the first display picture. The location can be the number of row and column. Looking up for the first original grayscale value and the first brightness compensation value in m-th row and n-th column in the first compensation table according to the location, then perform the calculation in the step S21, wherein m and n are integrals.

For example, the target grayscale vale of the target pixel point being displayed in the first display picture is 90, the driving device is stored with a first compensation table of an original grayscale value 64. When a brightness compensation value corresponding to the first original grayscale vale 64 of the target pixel point is 70, the fixing value is 90+70−64=96.

Optionally, after the driving device determines the location of the target pixel point, finding the second grayscale vale gs2 and the second brightness compensation vale ΔX2 corresponding to the target pixel point in the second compensation table according to the location, and the third grayscale vale gs3 and the third brightness compensation vale ΔX3 corresponding to the target pixel point in the third compensation table, judging values of the second grayscale vale gs2, the third grayscale vale gs3 and the target grayscale value gray0, if gs2<gray0<gs3, executing the calculation in step S22.

For example, the target grayscale vale of the target pixel point in the first display picture is 128, the driving device is stored with a second compensation table of an original grayscale value 80, when a second original grayscale value of the target pixel point is 80, a corresponding brightness compensation value is 87, and the driving device is also stored with a third compensation table of an original grayscale value 160, when a third original grayscale value of the target pixel point is 160, a corresponding brightness compensation value is 164, the fixing value is 164+(128−160)*(87−164)/(80−60)≤133.

As shown, in the embodiment of the present invention, the driving device receives the at least one compensation table, obtaining a target grayscale value of a target pixel point in a first display picture displayed by the display device, determining a fixing value corresponding to the target pixel point according to the at least one compensation table, a situation that in the at least one compensation table, only a first compensation table is existed and including a first grayscale vale and a first brightness compensation vale corresponding to the target pixel point, calculating a fixing value according to the first grayscale vale gs1 and a first brightness compensation vale in the first compensation table, if the number of the compensation tables is greater than 1, calculating a fixing value according to the multiple original grayscale values and multiple brightness compensation values. By this way, the calculation result of the brightness compensation value can be more reliable. Performing a brightness compensation for the target pixel points corresponding to the fixing value, and displaying the first display picture after performing the brightness compensation on the display device. A brightness uneven phenomenon in the first display picture caused by attenuation of the luminous efficiency of the OLED device can be eliminated.

Figure 2:
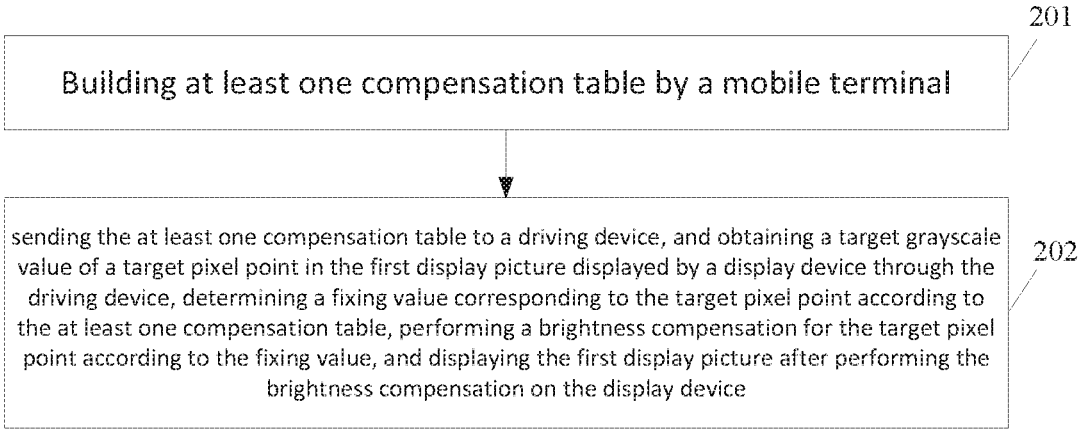
FIG. 2 is a flow chart of another brightness compensation method according to an embodiment of the present invention.

Consistently with the above embodiment, with reference to FIG. 2, FIG. 2 is a flow chart of another brightness compensation method according to an embodiment of the present invention. The brightness compensation method described in the present embodiment includes following steps:

Step 201: building at least one compensation table by a mobile terminal.

In the embodiment of the present application, an user can build at least one compensation table through the mobile terminal.

Wherein, all pixel points in the at least one compensation table correspond to a same original grayscale value. For example, a compensation table includes T pixel points with an original grayscale value to be 64. Because an ageing situation of the organic light-emitting diode corresponds to each pixel point is different, a brightness compensation value corresponds to each pixel point is also different, and T is an integral greater than or equal to 1.

Optionally, in the above step 201, the step of building at least one compensation table by a mobile terminal can include following steps:

A1: receiving a control instruction which is triggered from an user and sending a display instruction to a driving device by the mobile terminal. Wherein the display instruction is used for instructing the driving device to drive the display device to display a second display picture, and the second display picture is a pure color picture;

A2: receiving a shooting instruction triggered from the user, and shooting a target picture for the second display picture displayed by the display device, generating a compensation table i according to the target picture, wherein the compensation table i is any compensation table in the at least one compensation table.

In the embodiment of the present application, the control instruction is used for instructing the mobile terminal to start a brightness compensation, displaying an application interface of the brightness compensation and sending a displaying instruction to the driving device. The control instruction can be a group of continuous instructions.

Wherein the display instruction is used for instructing the driving device to drive the display device to display a second display picture, the user can set second display picture as a pure color picture, and set the original grayscale value corresponding to the pure color through the mobile terminal.

When the display device displays the second display picture, the user can shoot the target picture for the second display picture displayed by the display device through the mobile terminal. When shooting the target picture, the mobile terminal can generate a viewing frame having a same size as the second display picture displayed by the display device, and the user can take a picture after aligning an edge of the viewing frame with an edge of the second display picture. In this way, a target picture having a same size as the second display picture can be taken.

Optionally, in the above step A2, generating a compensation table i according to the target picture by the mobile terminal, can include following steps:

B1: displaying the target picture by the mobile terminal;

B2: receiving a picture amplification instruction triggered by the user, and enlarging the target picture;

B3: receiving a compensation setting information sent by the user, generating the compensation table i according to the compensation setting information. Wherein the compensation setting information include; a location information of a target region in the target picture, and an adjustment value for the target region.

In the present embodiment, resolutions of the second display picture and the target picture displayed by the display device are different. For example, the resolution of the second display picture can be 1920*1080, the resolution of the target picture can be 3200*1800. Because the size of the target picture and the size of the second display picture are the same, for N pixel points in the second display picture, each pixel point corresponds to a region in the target picture. The region can include at least one pixel point. For example, in the second display picture displayed by the display device, a pixel point at 100-th row and 100-th column can correspond to pixel points in 166th to 167-th rows and 166th to 167-th columns.

Optionally, the user can set to add an adjustment value for the target region, or set to decrease an adjustment value for target region.

Wherein enlarging the target picture is useful for selecting the target region in the target picture for the user.

Wherein the user can select a target region having an uneven brightness at the enlarged target picture at the mobile terminal, and set an adjustment value to the target region, the mobile terminal can determine the location information of the target region.

Optionally, in the above step B3, the step B3, generating a compensation table i according to the target picture by the mobile terminal, can include following steps:

C1: if the target region corresponds to the target pixel point in the display device, calculating brightness compensation values ΔXi of the target pixel point in the second display picture displayed by the display device according to following formula:

$$\Delta X_i = gs*(f+\Delta gray)/f$$

wherein, gs is an original grayscale value of the target pixel point in the second display picture displayed by the display device, f is a first average grayscale value of a region corresponding to the target pixel points in the target picture, Δgray is an adjustment value of the target region.

C2: if the target region includes K sub-regions, the K sub-regions respectively correspond to K pixel points in the second display picture displayed by the display device, the K pixel points includes the target pixel point, K is an integral greater than 1, then calculating brightness compensation values ΔXi of the target pixel point in the second display picture displayed by the display device according to following formula:

$$\Delta X_i = gs * \left( f + \Delta\text{gray} * \frac{d_1}{d_{max}} \right) \Big/ f$$

$$d_i = |f_i - \text{mean}|$$

Wherein, gs is an original grayscale value of the target pixel point in the second display picture displayed by the display device, f is a first average grayscale value of a region corresponding to the target pixel point in the target picture, fi is an average grayscale value in any sub-region in the K sub-regions, Δgray is an adjustment value of the target region, mean is a second average value of all pixel point in the target picture. For the K sub-regions, di is an absolute value of a difference between the second average grayscale value and an average grayscale value in any sub-region in the K sub-regions, d1 is an absolute value of a difference between the second average grayscale value and the first average grayscale value in a region corresponding to the target pixel point in the target picture, and dmax is a maximum of the absolute values of K differences corresponding to the K sub-regions.

C3: generating the compensation table i according to the brightness compensation value.

In the embodiment of the present application, the target region selected by the user can correspond to at least one pixel point in the second display picture displayed by the display device.

Optionally, obtaining a first average grayscale value f of a region corresponding to the target pixel points in the target picture. If the target region corresponds to the target pixel points in the second displaying region displayed by the display device, the first average grayscale value f is an average grayscale of the target region, and calculating brightness compensation values ΔXi of the target pixel point according to the formula in the step C1.

For example, the user selects 166-th to 167-th rows and 166-th to 167-th columns in the target picture, and setting the adjustment value to be increased by 10, the mobile terminal determines that an average grayscale value of the target region in the target picture is 90. The target point at 100-th row and 100-th column in the second display picture displayed by the display device can be determined according to the location information of the target region. Assuming that an original grayscale value of the target pixel point in the second display picture displayed by the display device is 64, the brightness compensation value of the target pixel point is 64*(90+10)/90≈71.

Optionally, if the target region corresponds to the K pixel points in the second display picture displayed by the display device, that is, the target region includes K sub-regions, each region in the K sub-regions corresponds to one pixel point in the second display picture displayed by the display device. For any sub-region, the mobile terminal can determine the location information of the sub-region, determining the target pixel point in the second display picture according to the location intimation, and the target pixel point is any pixel point in the K pixel points.

Wherein for the target region on the target picture selected by the user, the mobile terminal can obtain ab average grayscale value of each region in K sub-regions, obtain a second average grayscale value of all pixel points in the target picture, then calculating the brightness compensation value ΔXi of the target pixel point according to the formula is the step C2.

For example, the user selects the target region at 158-th to 167-th rows and 158-th to 167-th columns in the target picture, and setting the adjustment value to be increased by 10, the mobile terminal determine that a second average grayscale value of all pixel points in the target picture is 100. In the target region, an average grayscale value of the first sub-pixel at 166-th to 167-th rows and 166-th to 167-th columns is 90, and an absolute value of the difference with respective to the second average grayscale value is maximum, the first pixel point at 100-th row and 100-th column in the second display picture displayed by the display device can be determined according to the location information of the first sub-region. An average grayscale value of the second sub-pixel at 158-th to 159-th rows and 158-th to 159-th columns is 95, an absolute value of the difference with respective to the second average grayscale value is smaller, the second pixel point at 95-th row and 95-th column in the second display picture displayed by the display device can be determined according to the location information of the second sub-region, Assuming that an original grayscale value of the target pixel point in the second display picture displayed by the display device is 64, the brightness compensation value of the first pixel point at 100-th row and 100-th column is 64*(90+10)/90≈71, the brightness compensation value of the second pixel point at 95-th row and 95-th column is 64*(95+10*5/10)/95≈67.

Wherein, after the mobile terminal obtains a brightness compensation value for the target pixel point, the compensation table i can be generated, the compensation table i includes brightness compensation values of the pixel points in the second display picture displayed by the display device at a same original grayscale value.

Step 202: sending the at least one compensation table to a driving device, and obtaining a target grayscale value of a target pixel point in the first display picture displayed by a display device through the driving device, determining a fixing value corresponding to the target pixel point according to the at least one compensation table, performing a brightness compensation for the target pixel point according to the fixing value, and displaying the first display picture after performing the brightness compensation on the display device.

Optionally, after the user generates the compensation table i, the compensation table i can be sent to the driving device, the driving device can perform the brightness compensation to the second display picture according to the compensation table i, and driving the display device to display the second display picture after performing the brightness compensation. User can determine that if the compensation effect of the second display picture is satisfied. If the user is satisfied, sending an affirmance instruction to the driving device through the mobile terminal. The driving device reserves the compensation table I according to the affirmance instruction; if the user is not satisfied, the driving device perform a brightness compensation to the display picture according to a new compensation table until the user is satisfied.

As shown, in the embodiment of the present invention, the mobile terminal builds at least one compensation table. Wherein, the user shoots a target picture through the mobile device, the user selects the target region in the target picture. If the target region corresponds to the target pixel points in the display device, calculating brightness compensation values through a first average grayscale value of a region corresponding to the target pixel points in the target picture.

If the target region corresponds to multiple pixel points in the display picture displayed by the display device, calculating the brightness compensation value of each pixel point of the multiple pixel points according to an average grayscale value of the sub-region of each pixel in the multiple pixel points in the target region. By this way, the calculation result of the brightness compensation value can be more reliable. The mobile terminal generates anyone in the at least one compensation table according to the above brightness compensation value, sending the at least one compensation table to the driving device, obtaining target grayscale values of the target pixel points in the first display picture displayed by the display device through the driving device. Determining fixing value corresponding to the target pixel points according to the at least one compensation table, performing a brightness compensation for the target pixel points corresponding to the fixing value, and displaying the first display picture after performing the brightness compensation on the display device. A brightness uneven phenomenon in the first display picture caused by attenuation of the luminous efficiency of the OLED device can be eliminated.

Figure 3:
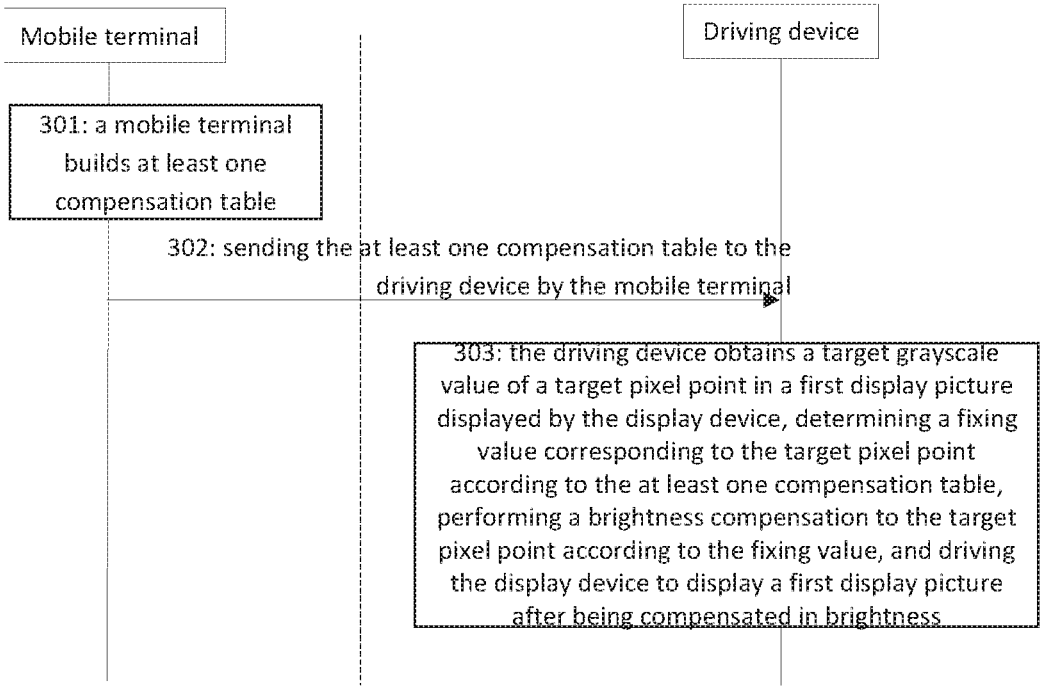
FIG. 3 is a flow chart of another brightness compensation method according to an embodiment of the present invention.

With reference to FIG. 3, FIG. 3 is a flow chart of another brightness compensation method according to an embodiment of the present invention. The brightness compensation method described in the present embodiment includes following steps:

Step 301: a mobile terminal builds at least one compensation table.

Optionally, after an user shoots a target picture through the mobile terminal, sending the target picture to a server through the mobile terminal, and the server calculates brightness compensation values ΔXi of the target pixel point in the second display picture displayed by the display device according to following formula:

$$\Delta X_i = gs * f / mean$$

wherein, gs is an original grayscale value of the target pixel point in the second display picture displayed by the display device, f is a first average grayscale value of a region corresponding to the target pixel points in the target picture, mean is a second average value of all pixel points in the target picture, generating the compensation table i according to the brightness compensation values, and sending the compensation table i to the driving device.

Wherein, building the compensation table through the server, setting a compensation information in the mobile device by the user is not required so as the save the operation of the user. Besides, building the compensation table through the server, the operation of the mobile device can be saved in order to reduce the consumption of the memory of the mobile terminal.

Step S302: sending the at least one compensation table to the driving device by the mobile terminal.

Step S303: the driving device obtains a target grayscale value of a target pixel point in a first display picture displayed by the display device, determining a fixing value corresponding to the target pixel point according to the at least one compensation table, performing a brightness compensation to the target pixel point according to the fixing value, and driving the display device to display a first display picture after being compensated in brightness.

As shown, in the embodiment of the present invention, the mobile terminal builds at least one compensation table. Wherein after an user shoots a target picture through the mobile terminal, sending the target picture to a server through the mobile terminal, and the server builds anyone of the at least one compensation table. The mobile terminal sends the at least one compensation table to the driving device. The deriving device receives the at least one compensation table, obtains a target grayscale value of a target pixel point in a first display picture displayed by the display device, determining a fixing value corresponding to the target pixel point according to the at least one compensation table, wherein, each compensation table includes an original grayscale value of at least one pixel in a display picture of a display device, and a brightness compensation value corresponding to the original grayscale value, obtaining the fixing value according to at least one original grayscale value and at least one brightness compensation value, performing a brightness compensation to the target pixel point according to the fixing value, and driving the display device to display a first display picture after being compensated in brightness. A brightness uneven phenomenon in the first display picture caused by attenuation of the luminous efficiency of the OLED device can be eliminated. Besides, building the compensation table through the server, the operation of the mobile device can be saved in order to shorten the time for building the compensation table.

With reference to FIG. 4, and FIG. 4 is a schematic diagram of a driving device provided by an embodiment of the present invention. The driving device includes a receiving unit 401 and a brightness compensation unit 402.

The receiving unit 401 is used for receiving at least one compensation table sent by a mobile terminal.

The brightness compensation unit 402 is used for obtaining a target grayscale value of a target pixel point in a first display picture displayed by the display device, determining a fixing value corresponding to the target pixel point according to the at least one compensation table, performing a brightness compensation to the target pixel point according to the fixing value, and driving the display device to display the first display picture after performing the brightness compensation.

Figure 4A:
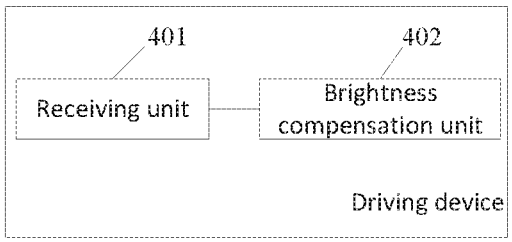
FIG. 4A is a schematic diagram of a driving device provided by an embodiment of the present invention.
Figure 4B:
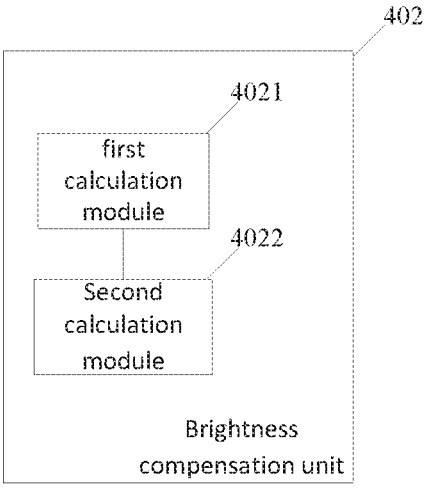
FIG. 4B is a specific detail structure of the brightness compensation unit 402 described in FIG. 4A.

Optionally, with reference to FIG. 4B, and FIG. 4B is a specific detail structure of the brightness compensation unit 402 described in FIG. 4A. The brightness compensation unit 402 can include: a first calculation module 4021 and a second calculation module 4022. Specifically:

The first calculation module 4021 is used for in a situation that in the at least one compensation table, only a first compensation table is existed and including a first grayscale vale gs1 and a first brightness compensation vale ΔX1 corresponding to the target pixel point, obtaining the first grayscale vale gs1 and a first brightness compensation vale ΔX1 in the first compensation table, and calculating a fixing value L corresponding to the target pixel point according to a following formula:

$$L = gray0 + \Delta X_1 - gs1$$

Wherein, gray0 is the target grayscale value of the target pixel point in the first display picture displayed by the display device The second calculation module 4022 is used for in a situation that in the at least one compensation table, a second compensation table is existed and including a second grayscale vale gs2 and a second brightness compensation vale ΔX2 corresponding to the target pixel point, and a third compensation table is existed and including a third grayscale vale gs3 and a third brightness compensation vale ΔX3 corresponding to the target pixel point, obtaining the second grayscale value gs2 and the second brightness compensation vale ΔX2 corresponding to the target pixel point in the second compensation table and obtaining the third grayscale vale gs3 and the third brightness compensation vale ΔX3 corresponding to the target pixel point in the third compensation table, calculating the fixing value L corresponding to the target pixel point according to a following formula:

$$L=\Delta X_2+(\text{gray0}-\text{gs2})*(\Delta X_3-\Delta X_2)/(\text{gs3}-\text{gs2})$$

wherein, gray0 is the target grayscale value of the target pixel point in the first display picture displayed by the display device, and gs2<gray0<gs3.

As shown, in the embodiment of the present invention, the driving device receives the at least one compensation table, obtains a target grayscale value of a target pixel point in a first display picture displayed by the display device, determining a fixing value corresponding to the target pixel point according to the at least one compensation table, a situation that in the at least one compensation table, only a first compensation table is existed and including a first grayscale vale and a first brightness compensation vale corresponding to the target pixel point, calculating a fixing value according to the first grayscale vale gs1 and a first brightness compensation vale in the first compensation table, if the number of the compensation tables is greater than 1, calculating a fixing value according to the multiple original grayscale values and multiple brightness compensation values. By this way, the calculation result of the brightness compensation value can be more reliable. Performing a brightness compensation for the target pixel points corresponding to the fixing value, and displaying the first display picture after performing the brightness compensation on the display device. A brightness uneven phenomenon in the first display picture caused by attenuation of the luminous efficiency of the OLED device can be eliminated.

Figure 5A:
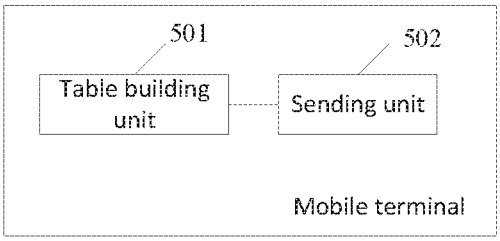
FIG. 5A is a schematic diagram of a driving device provided by an embodiment of the present invention.

With reference to FIG. 5A, and FIG. 5A is a schematic diagram of a driving device provided by an embodiment of the present invention. The driving device includes a table building unit 501 and a sending unit 502. Wherein, the table building unit 501 is used for building at least one compensation table.

The sending unit 502 is used for sending the at least one compensation table to the driving device, and obtaining target grayscale values of the target pixel points in the first displaying picture displayed by the display device through the driving device, determining fixing value corresponding to the target pixel points according to the at least one compensation table, performing a brightness compensation for the target pixel points corresponding to the fixing value, and driving the display device to display the first displaying picture after performing the brightness compensation on the display device.

Figure 5B:
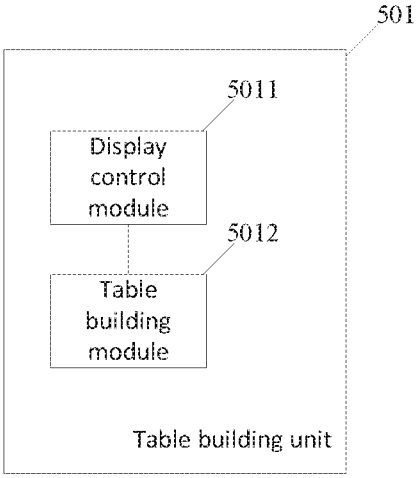
FIG. 5B is a specific detail structure of the table building unit 501 described in FIG. 5A.

Optionally, with reference to FIG. 5B, and FIG. 5B is a specific detail structure of the table building unit 501 described in FIG. 5A. The table building unit 501 can include: a display control module 5011 and a table building module 5012. Specifically:

The display control module 5011 is used for receiving a control instruction which is triggered from an user and sending a display instruction to a driving device in the mobile terminal. Wherein the display instruction is used for instructing the driving device to drive the display device to display a second display picture, and the second display picture is a pure color picture.

The table building module 5012 is used for receiving a shooting instruction triggered by the user, and shooting a target picture for the second displaying picture displayed by the display device, generating a compensation table i according to the target picture, wherein the compensation table i is any compensation table in the at least one compensation table.

Figure 5C:
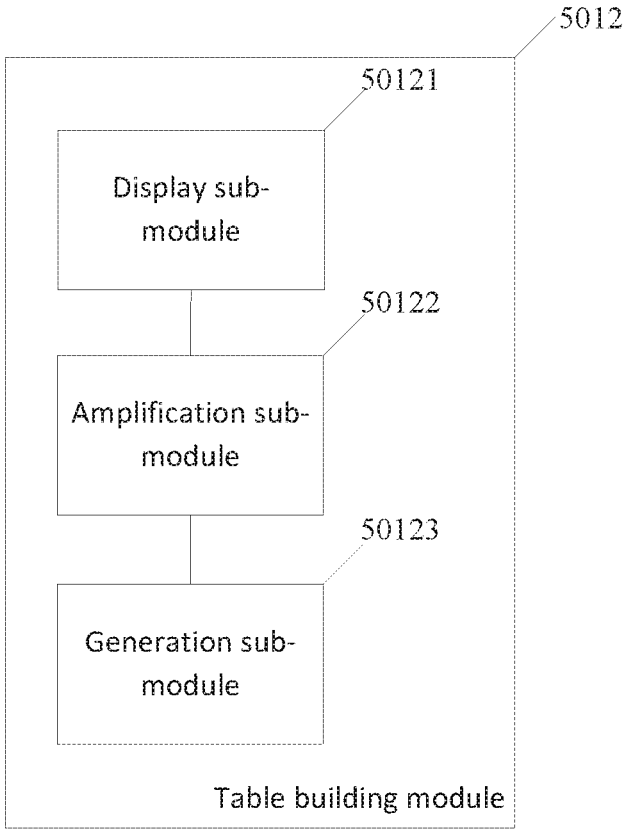
FIG. 5C is a specific detail structure of the table building module 5012 described in FIG. 5B.

Optionally, with reference to FIG. 5C, and FIG. 5C is a specific detail structure of the table building module 5012 described in FIG. 5B. The table building module 5012 can include: a display sub-module 50121, an amplification sub-module 50122, and a generation sub-module 50123. Specifically: the display sub-module 50121 is used for displaying the target picture on the mobile terminal; the amplification sub-module 50122 is used for receiving a picture amplification instruction triggered by the user, and enlarging the target picture; the generation sub-module 50123 is used for receiving a compensation setting information sent by the user, generating a compensation table i according to the compensation setting information. Wherein the compensation setting information include: a location information of a target region in the target picture, and an adjustment value for the target region.

Optionally, the generation sub-module 50123 of the mobile terminal generates the compensation table i according to the compensation setting information, specifically: if the target region corresponds to the target pixel points in the second display picture of the display device, calculating brightness compensation values ΔXi of the target pixel point in the second display picture of the display device according to following formula:

$$\Delta X_i=\text{gs}*(f+\Delta\text{gray})/f$$

wherein, gs is an original grayscale value of the target pixel point in the second display picture of the display device, f is a first average grayscale value of a region of the target pixel point corresponding to the target picture, Δgray is an adjustment value of the target region.

if the target region includes K sub-regions, the K sub-regions respectively correspond to K pixel points in the second display picture of the display device. K is an integral greater than 1, then calculating brightness compensation values ΔXi of the target pixel point in the second display picture of the display device according to following formula:

$$\Delta X_i = gs*\left(f+\Delta\text{gray}*\frac{d_1}{d_{max}}\right)\Big/ f$$

$$d_i = |f_i - \text{mean}|$$

wherein, gs is an original grayscale value of the target pixel point in the second display picture displayed by the display device, f is a first average grayscale value of a region corresponding to the target pixel points in the target picture, fi is an average grayscale value in any sub-region in the K sub-regions, Δgray is an adjustment value of the target region, mean is a second average value of all pixel point in the target picture. For the K sub-regions, di is an absolute value of a difference between the second average grayscale value and an average grayscale value in any sub-region in the K sub-regions, d1 is an absolute value of a difference between the second average grayscale value and a first average grayscale value in a region corresponding to the target pixel point in the target picture, and dmax is a maximum of the absolute values of K differences corresponding t K sub-regions.

generating the compensation table i according to the brightness compensation value.

As shown, in the embodiment of the present invention, the mobile terminal builds at least one compensation table.

Wherein, the user shoots a target picture through the mobile device, the user selects the target region in the target picture. If the target region corresponds to the target pixel points in the display device, calculating brightness compensation values through a first average grayscale value of a region corresponding to the target pixel points in the target picture. If the target region corresponds to multiple pixel points in the display picture displayed by the display device, calculating the brightness compensation value of each pixel point of the multiple pixel points according to an average grayscale value of the sub-region of each pixel in the multiple pixel points in the target region. By this way, the calculation result of the brightness compensation value can be more reliable. The mobile terminal generates anyone in the at least one compensation table according to the above brightness compensation value, sending the at least one compensation table to the driving device, obtaining target grayscale values of the target pixel points in the first display picture displayed by the display device through the driving device. Determining fixing value corresponding to the target pixel points according to the at least one compensation table, performing a brightness compensation for the target pixel points corresponding to the fixing value, and displaying the first display picture after performing the brightness compensation on the display device. A brightness uneven phenomenon in the first display picture caused by attenuation of the luminous efficiency of the OLED device can be eliminated.

Figure 6:
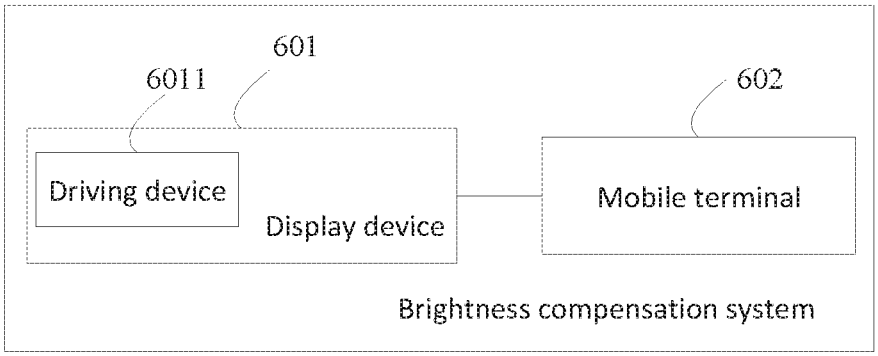
FIG. 6 is a schematic diagram of a brightness compensation system according to an embodiment of the present invention.

As shown in FIG. 6, FIG. 6 is a schematic diagram of a brightness compensation system according to an embodiment of the present invention. The brightness compensation system includes a display device 601 and a mobile terminal 602, the display device includes a driving device 6011.

Figure 7:
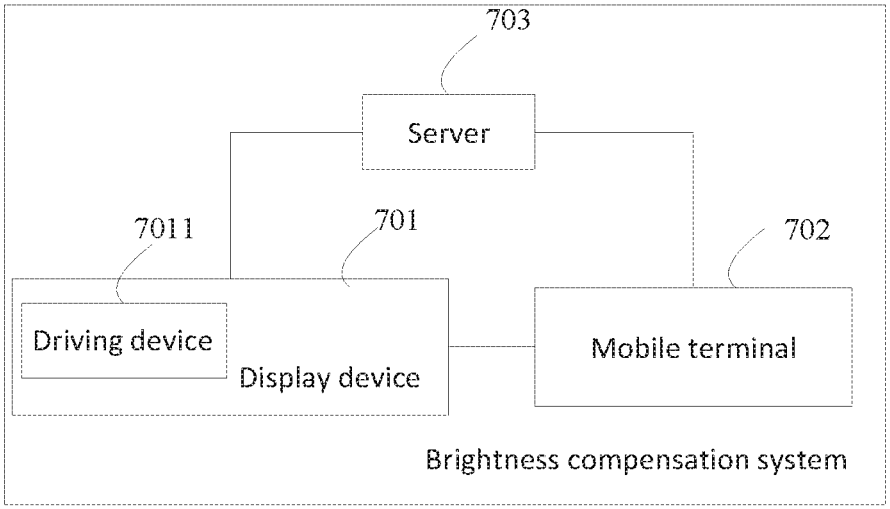
FIG. 7 is a schematic diagram of another brightness compensation system according to an embodiment of the present invention.

As shown in FIG. 7, FIG. 7 is a schematic diagram of another brightness compensation system according to an embodiment of the present invention. The brightness compensation system includes a display device 701 and a mobile terminal 702 and a server 703, the display device includes a driving device 7011.

Figure 8:
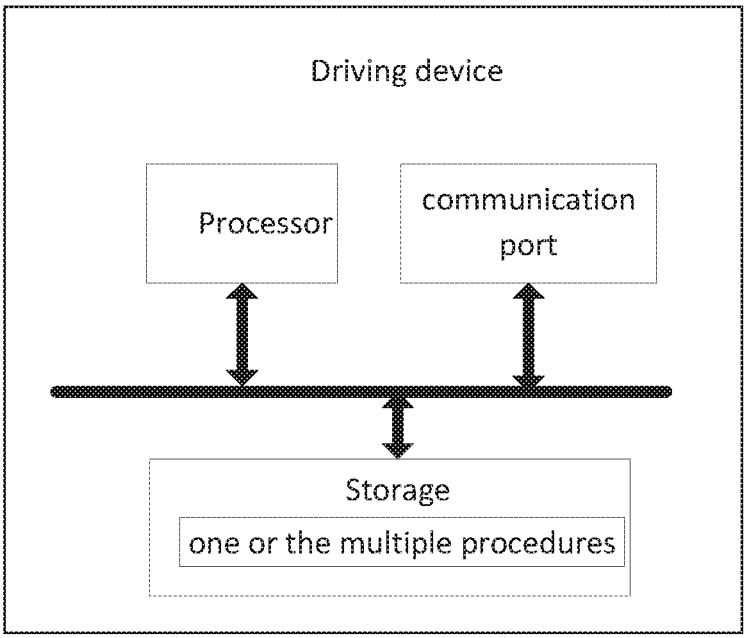
FIG. 8 is a schematic diagram of a driving device according to an embodiment of the present invention.

As shown in FIG. 8, FIG. 8 is a schematic diagram of a driving device according to an embodiment of the present invention. The driving device described in FIG. 8 includes: at least one processor, at least one storage and at least one communication port; and one or multiple procedures.

The one or the multiple procedures are stored in the storage, and configured to be executed in the processor, the procedures include instructions for executing the following steps:

receiving at least one compensation table sent by a mobile terminal;

obtaining a target grayscale value of a target pixel point in a first display picture of the display device, determining a fixing value corresponding to the target pixel point according to the at least one compensation table, performing a brightness compensation to the target pixel point according to the fixing value, and driving the display device to display the first display picture after performing a brightness compensation.

In some embodiments of the present invention, the procedure includes instructions for executing following steps:

in the at least one compensation table, only a first compensation table is existed and including a first grayscale vale gs1 and a first brightness compensation vale ΔX1 corresponding to the target pixel point, obtaining the first grayscale vale gs1 and a first brightness compensation vale ΔX1 in the first compensation table, and calculating a fixing value L corresponding to the target pixel point according to a following formula:

$$L=\text{gray0}+\Delta X_1-\text{gs1}$$

wherein, gray0 is the target grayscale value of the target pixel point in the first display picture of the display device.

If in the at least one compensation table, a second compensation table is existed and including a second grayscale vale gs2 and a second brightness compensation vale ΔX2 corresponding to the target pixel point, and a third compensation table is existed and including a third grayscale vale gs3 and a third brightness compensation vale ΔX3 corresponding to the target pixel point, obtaining the second grayscale value gs2 and the second brightness compensation vale ΔX2 corresponding to the target pixel point in time second compensation table and obtaining the third grayscale vale gs3 and the third brightness compensation vale ΔX3 corresponding to the target pixel point in the third compensation table, calculating the fixing value L corresponding to the target pixel point according to a following formula:

$$L=\Delta X_2+(\text{gray0}-gs2)*(\Delta X_3-\Delta X_2)/(gs3-gs2)$$

wherein, gray0 is the target grayscale value of the target pixel point in time first display picture of the display device, and gs2<gray0<gs3.

Figure 9:
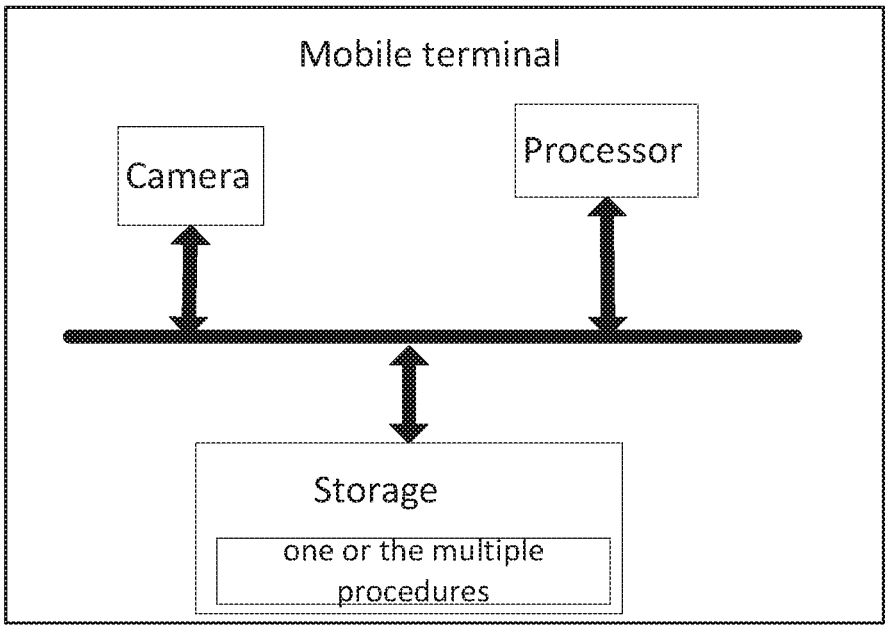
FIG. 9 is a schematic diagram of a mobile terminal according to an embodiment of the present invention.

As shown in FIG. 9, FIG. 9 is a schematic diagram of a mobile terminal according to an embodiment of the present invention. The mobile terminal described in FIG. 9 includes: a processor, a storage and a camera; and one or multiple procedures.

The one or the multiple procedures are stored in the storage, and configured to be executed in the processor, the procedures include instructions for executing the following steps:

building at least one compensation table by a mobile terminal; and sending the at least one compensation table to a driving device, and obtaining a target grayscale value of a target pixel point in the first display picture displayed by a display device through the driving device, determining a fixing value corresponding to the target pixel point according to the at least one compensation table, performing a brightness compensation for the target pixel point according to the fixing value, and displaying the first display picture after performing the brightness compensation on the display device.

In some embodiments of the present invention, the procedure includes instructions for executing following steps:

receiving a control instruction which is triggered from an user and sending a display instruction to a driving device by the mobile terminal, wherein the display instruction is used for instructing the driving device to drive the display device to display a second display picture, and the second display picture is a pure color picture; and receiving a shooting instruction triggered from the user, and shooting a target picture for the second display picture displayed by the display device, generating a compensation table i according to the target picture, wherein the compensation table i is any compensation table in the at least one compensation table.

In some embodiments of the present invention, the procedure includes instructions for executing following steps:

displaying the target picture by the mobile terminal;

receiving a picture amplification instruction triggered by the user, and enlarging the target picture; and receiving a compensation setting information sent by the user, generating the compensation table i according to the compensation setting information, wherein the compensation setting information include: a location information of a target region in the target picture, and an adjustment value for the target region.

In some embodiments of the present invention, the procedure includes instructions for executing following steps:

if the target region corresponds to the target pixel point in the display device, calculating brightness compensation values ΔXi of the target pixel point in the second display picture displayed by the display device according to following formula:

$$\Delta X_i = gs*(f+\Delta gray)/f$$

wherein, gs is an original grayscale value of the target pixel point in the second display picture displayed by the display device, f is a first average grayscale value of a region corresponding to the target pixel points in the target picture, Δgray is an adjustment value of the target region;

if the target region includes K sub-regions, the K sub-regions respectively correspond to K pixel points in the second display picture displayed by the display device, the K pixel points includes the target pixel point, K is an integral greater than 1, then calculating brightness compensation values ΔXi of the target pixel point in the second display picture displayed by the display device according to following formula:

$$\Delta X_i = gs*\left(f + \Delta gray* \frac{d_1}{d_{max}}\right)\Big/ f$$

$$d_i = |f_i - mean|$$

wherein, gs is an original grayscale value of the target pixel point in the second display picture displayed by the display device, f is a first average grayscale value of a region corresponding to the target pixel point in the target picture, fi is an average grayscale value in any sub-region in the K sub-regions, Δgray is an adjustment value of the target region, mean is a second average value of all pixel point in the target picture; for the K sub-regions, di is an absolute value of a difference between the second average grayscale value and an average grayscale value in any sub-region in the K sub-regions, d1 is an absolute value of a difference between the second average grayscale value and the first average grayscale value in a region corresponding to the target pixel point in the target picture, and dmax is a maximum of the absolute values of K differences corresponding to the K sub-regions; and generating the compensation table i according to the brightness compensation value.

The embodiment of the preset application provides a computer storage media, wherein, computer storage media is used for storing computer program for electric data exchanging. The computer program make a computer to execute part or all steps of any method describe in the method embodiment shown in FIG. 1B, and the computer includes a driving device.

The embodiment of the preset application also provides with a computer program product, wherein the computer program product includes a non-transitory computer-readable storage medium that stores the computer program, the computer program makes a computer to execute part or all steps in FIG. 1B, the computer program product can be a software installation package, and the computer includes the driving device.

The embodiment of the preset application provides a computer storage media, wherein, computer storage media is used for storing computer program for electric data exchanging. The computer program make a computer to execute part or all steps of any method describe in the method embodiment shown in FIG. 2, and the computer includes a mobile terminal.

The embodiment of the preset application also provides with a computer program product, wherein the computer program product includes a non-transitory computer-readable storage medium that stores the computer program, the computer program makes a computer to execute part or all steps in FIG. 2, the computer program product can be a software installation package, and the computer includes the mobile terminal.

It should be noted that, the foregoing method embodiment is expressed as a series of action combinations for the purpose of brief description, but persons skilled, in the art should know that the present invention is not limited to the described action sequence, because some steps may be performed in another sequence or simultaneously according to the present invention. Besides, persons skilled in the art should also know that the embodiment described in this specification is an exemplary embodiment, and the involved actions and modules are not mandatory in the present invention.

In the above embodiment, the description of each embodiment has its own emphasis; some portion that is not described in detail in some embodiment can refer to the related description of the other embodiment.

According to the embodiments provided by the present disclosure, it should be understood that the disclosed equipment and method may be implemented in another manner. The equipment embodiment described above is only schematic, and for example, division of the units is only logic function division, and during practical implementation, another division manner may be adopted, for example: multiple units or components may be combined, or may be integrated into another system, or some characteristics may be neglected, or may not be executed. In addition, coupling, or direct coupling or communication connections between each displayed or discussed component may be indirect coupling or communication connections implemented through some interfaces, equipment or units, and may be of electrical, mechanical or other forms.

The units described above as separate parts may be, or may not be physically separated, and the parts displayed as units may be, or may not be physical units, that is, they may be located in the same place, and may also be distributed on multiple network units; and part of or all the units may be selected to achieve the purpose of the solution of the embodiment according to a practical requirement.

In addition, each functional unit in each embodiment of the present disclosure may be integrated in the same processing unit, and may also be used as an independent unit, and two or more than two units may also be integrated in one unit; and the integrated units may be implemented in a hardware form, and may also be implemented in form of combining hardware and software functional units If the integrated unit is realized by a software function and being sold and used as an independent product. The integrated unit implemented in the form of a software functional unit described above may be stored in a computer-readable storage medium. The software functional unit is stored in a storage medium and includes several instructions that enable a computer device (may be a personal computer, a server, or network device) to perform the steps of the methods of the various embodiments of the present invention. The storage medium includes: U disk, mobile hard disk, a read-only memory (Read-Only Memory, referred to as ROM), a random access memory (Random Access Memory, referred to as RAM), magnetic disk, or an optical disc of various program codes may be stored media.

Those skilled in the art should understand that: all or part of the steps implementing the method embodiment may be implemented through related hardware instructed by a program, the program may be stored in a computer-readable storage medium, and when the program is executed, the steps of the method embodiment are executed; and the storage medium includes: various media capable of storing program codes such as mobile storage equipment, a Read-Only Memory (ROM), a Random Access Memory (RAM), a magnetic disk or a compact disc.

The above is only the specific implementation mode of the present disclosure and not intended to limit the scope of protection of the present disclosure, and any variations or replacements apparent to those skilled in the art within the technical scope of the present disclosure shall fall within the scope of protection of the present disclosure. Therefore, the scope of protection of the present disclosure should be the scope of protection of the claims.

What is claimed is:

1. A brightness compensation method, comprising steps of:

receiving at least one compensation table sent from a mobile terminal by a driving device;

obtaining a target grayscale value of a target pixel point in a first display picture of a display device, determining a fixing value corresponding to the target pixel point according to the at least one compensation table, performing a brightness compensation to the target pixel point according to the fixing value, and driving the display device to display the first display picture after performing the brightness compensation;

wherein the step of determining the fixing value corresponding to the target pixel point according to the at least one compensation table comprises:

if in the at least one compensation table, only a first compensation table is existed and including a first grayscale vale gs1 and a first brightness compensation vale ΔX1 corresponding to the target pixel point, obtaining the first grayscale value gs1 and the first brightness compensation vale ΔX1 in the first compensation table, and calculating the fixing value L corresponding to the target pixel point according to a following formula:

$$L=\text{gray0}+\Delta X_1-gs1$$

wherein gray0 is the target grayscale value of the target pixel point in the first display picture displayed by the display device;

if in the at least one compensation table, a second compensation table is existed and including a second grayscale value gs2 and a second brightness compensation value ΔX2 corresponding to the target pixel point, and a third compensation table is existed and including a third grayscale value gs3 and a third brightness compensation value ΔX3 corresponding to the target pixel point, obtaining the second grayscale value gs2 and the second brightness compensation value ΔX2 corresponding to the target pixel point in the second compensation table and obtaining the third grayscale value gs3 and the third brightness compensation value ΔX3 corresponding to the target pixel point in the third compensation table, calculating the fixing value L corresponding to the target pixel point according to a following formula:

$$L=\Delta X_2+(\text{gray0}-gs2)*(\Delta X_3-\Delta X_2)/(gs3-gs2)$$

wherein, gray0 is the target grayscale value of the target pixel point in the first display picture displayed by the display device, and gs2<gray0<gs3.

2. A brightness compensation method, comprising steps of:

building at least one compensation table by a mobile terminal; and sending the at least one compensation table to a driving device, and obtaining a target grayscale value of a target pixel point in a first display picture displayed by a display device through the driving device, determining a fixing value corresponding to the target pixel point according to the at least one compensation table, performing a brightness compensation for the target pixel point according to the fixing value, and displaying the first display picture after performing the brightness compensation on the display device;

wherein the step of building at least one compensation table by a mobile terminal comprises:

receiving a control instruction which is triggered from a user and sending a display instruction to a driving device by the mobile terminal, wherein the display instruction is used for instructing the driving device to drive the display device to display a second display picture, and the second display picture is a pure color picture; and receiving a shooting instruction triggered from the user, and shooting a target picture for the second display picture displayed by the display device, generating a compensation table i according to the target picture, wherein the compensation table i is any compensation table in the at least one compensation table;

wherein the step of generating a compensation table i according to the target picture by the mobile terminal comprises:

displaying the target picture by the mobile terminal;

receiving a picture amplification instruction triggered by the user, and enlarging the target picture; and receiving a compensation setting information sent by the user, generating the compensation table i according to the compensation setting information, wherein the compensation setting information include: a location information of a target region in the target picture, and an adjustment value for the target region;

wherein the step of generating the compensation table i according to the compensation setting information comprises:

if the target region corresponds to the target pixel point in the display device, calculating brightness compensation values ΔXi of the target pixel point in the second display picture displayed by the display device according to following formula:

$$\Delta X_i=gs*(f+\Delta\text{gray})/f$$

wherein, gs is an original grayscale value of the target pixel point in the second display picture displayed by the display device, f is a first average grayscale value of a region corresponding to the target pixel points in the target picture, Δgray is an adjustment value of the target region;

if the target region includes K sub-regions, the K sub-regions respectively correspond to K pixel points in the second display picture displayed by the display device, the K pixel points includes the target pixel point, K is an integral greater than 1, then calculating brightness compensation values ΔXi of the target pixel point in the second display picture displayed by the display device according to following formula:

$$\Delta X_i = gs * \left( f + \Delta\text{gray} * \frac{d_1}{d_{max}} \right) \Big/ f$$

$$d_i = |f_i - \text{mean}|$$

wherein, gs is an original grayscale value of the target pixel point in the second display picture displayed by the display device, f is a first average grayscale value of a region corresponding to the target pixel point in the target picture, fi is an average grayscale value in any sub-region in the K sub-regions, Δgray is an adjustment value of the target region, mean is a second average value of all pixel point in the target picture; for the K sub-regions, di is an absolute value of a difference between the second average grayscale value and an average grayscale value in any sub-region in the K sub-regions, d1 is an absolute value of a difference between the second average grayscale value and the first average grayscale value in a region corresponding to the target pixel point in the target picture, and dmax is a maximum of the absolute values of K differences corresponding to the K sub-regions; and generating the compensation table i according to the brightness compensation value.

3. The method according to claim 2 wherein the method further comprises:

sending the target picture to a server, and the server calculates the brightness compensation value ΔXi of the target pixel point in the second display picture displayed by the display device according to following formula:

$$\Delta X_i = gs * f / \text{mean}$$

wherein, gs is an original grayscale value of the target pixel point in the second display picture displayed by the display device, f is a first average grayscale value of a region corresponding to the target pixel points in the target picture, mean is a second average value of all pixel points in the target picture, generating the compensation table i according to the brightness compensation values, and sending the compensation table i to the driving device.

* * * * *